United States Patent [19]

Mays

[11] 4,230,051

[45] Oct. 28, 1980

[54] PALLETS WITH CARGO POSITIONING AND RETAINING STRUCTURE

[75] Inventor: Gerald F. Mays, Timonium, Md.

[73] Assignee: The Nelson Company, Baltimore, Md.

[21] Appl. No.: 35,442

[22] Filed: May 3, 1979

Related U.S. Application Data

[63] Continuation-in-part of Ser. No. 834,064, Sep. 16, 1977, abandoned, which is a continuation-in-part of Ser. No. 796,652, May 13, 1977, abandoned.

[51] Int. Cl.[2] ..... B65D 19/26; B65D 19/40; B65D 19/44

[52] U.S. Cl. ..... 108/55.1; 52/514; 108/51.1; 108/55.3

[58] Field of Search ..... 108/51.1, 53.1–57.1; 217/43 A; 206/386, 599, 600; 52/514

[56] References Cited

U.S. PATENT DOCUMENTS

| | | | |
|---|---|---|---|
| 2,014,892 | 9/1935 | Graham et al. | 52/514 X |
| 2,470,514 | 5/1949 | Muller | 52/514 |
| 2,673,700 | 3/1954 | Eberhardt | 108/53.5 |
| 2,828,040 | 3/1958 | Fitton et al. | 108/55.1 X |
| 2,843,260 | 7/1958 | Sommer | 217/43 A X |

FOREIGN PATENT DOCUMENTS

| | | | |
|---|---|---|---|
| 699468 | 12/1964 | Canada | 108/55.1 |
| 1481324 | 4/1969 | Fed. Rep. of Germany | 108/51.1 |
| 2301441 | 9/1976 | France | 108/56.1 |
| 588878 | 2/1959 | Italy | 108/55.1 |

OTHER PUBLICATIONS

"Nail Reinforced Pallet Stringers, A Pilot Study", E. George Stern, VPI Wood Research & Wood Construction Laboratory, Jul. 1972.

"Nail Reinforced Pallet Stringers, Part II", E. George Stern, VPI Wood Research & Wood Construction Laboratory, Sep. 1972.

"Better Utilization of Wood Through Assembly with Improved Fasteners", E. George Stern, VPI Research & Wood Construction Laboratory, Sep. 1972.

*Primary Examiner*—William E. Lyddane

*Attorney, Agent, or Firm*—A. W. Breiner

[57] ABSTRACT

Pallets for material transport and to be handled with forklift trucks comprising deckboards nailed to vertically disposed stringers and including means for engagement and lifting with the fork of a forklift truck having metal U members positioned at at least the two sides or two ends of the pallet and extending a distance above the deckboards sufficient to position and retain cargo, the ends of the U members disposed substantially completely through the stringer at the stringer ends to provide reinforcement to the stringers. Metal reinforcing pins can be disposed completely within the stringer to provide additional reinforcement of the stringers without weakening of the deckboards or interfering with nailing and repairing operations.

6 Claims, 3 Drawing Figures

PALLETS WITH CARGO POSITIONING AND RETAINING STRUCTURE

RELATED INVENTIONS

This application is a continuation-in-part of pending application Ser. No. 834,064 filed Sept. 16, 1977 now abondoned which in turn is a continuation-in-part of application Ser. No. 796,652 filed May 13, 1977 also now abandoned.

FIELD OF INVENTION AND BACKGROUND

This invention is directed to wooden pallets for material transport which are handled with forklift trucks, and to their method of manufacture. More particularly, the invention is directed to pallets comprising deckboards nailed to vertically disposed stringers which are reinforced and adapted to help position and retain cargo thereon.

Pallets are used in ever-increasing number in commerce to transport virtually all types of merchandise. These pallets when loaded with merchandise almost by necessity are handled with forklift trucks. When empty, however, they can be handled with forklift trucks, but oftentimes are manually stacked or moved manually from one location to another. Pallets, therefore, while of simple design must meet numerous specifications, many of which are conflicting.

More specifically, pallets since they are a service item must be relatively inexpensive. To be inexpensive, they must be made of materials of relatively low cost and must be fabricated in a manner which will make most effective use of labor. Since the pallets are at times handled manually and since they are shipped from place to place with merchandise, they must be relatively light in weight in addition to having high structural strength. Most pallets, therefore, are made of wood and comprise vertical stringers with transverse deckboards nailed thereto, top and bottom. To facilitate handling with forklift trucks, the pallets preferably are designed for pick up from the sides as well as from the ends of the pallet, i.e., a so-called four-way pallet as opposed to a two-way pallet if pick up is from the ends only; and, accordingly, the stringers are notched for entrance of the fork of the forklift truck. In construction, after cutting to proper length and notching, the stringers are fed to automatic stringer "feed boxes," with the deckboards then being applied and nailed with nail handguns or automatic nailers.

In spite of the acceptance of wood as the logical choice of material for pallet construction, pallets constructed from wood are subject to damage or breakage due to heavy loading and in being subjected to substantial mechanical impact from the fork end of the forklift truck due at times to simple operator carelessness or indifference. Breakage in pallets occurs most often at the end of the stringers and, if the stringers are notched, substantially immediately adjacent to the notch. In order to reduce breakage and to increase the strength of wood pallets, various modifications to pallets have been suggested including incorporating metal braces between the stringers and deckboards; applying metal bands to the pallets at strategic points; using reinforcing nails pounded into the stringers, as well as constructing the pallets with bolts extending through the stringer and deckboards. These efforts have been unacceptable to large users for various reasons. Metal braces and metal bands applied to the pallets not only increase material cost and at times make the pallets unacceptably heavy, but also increase labor costs during the course of construction and in large measure preclude the use of conventional automatic stringer feed boxes and nailing machines. Moveover, a pallet containing the metal braces and/or bands is difficult to repair once damaged since the conventional method of cutting the nails between the deckboards and stringers or otherwise conventional methods of pulling the nails connecting the deckboards and stringers cannot be conveniently employed. Nail reinforcement, while providing some improvement, has been limited by the lack of rigidity provided by reinforcement with relatively flexible nails driven into the stringer. Bolts extending through the stringers and deckboards, while improving structural integrity, again greatly increase cost both from the standpoint of initial construction and repair. In the initial construction it is necessary to drill the deckboards and stringers in substantially perfect alignment and then insert the bolts. In order to avoid having boltheads or nuts interfere with the stacking of merchandise on the pallets and/or interfering with the setting down of the pallets and/or damaging merchandise when one loaded pallet is placed on another loaded pallet, the boltheads and nuts must be countersunk to provide a flush surface. This further increases the cost of the manufacturing operation and also requires the use of relatively thick deckboards for adequate strength. The countersinking of the boltheads into the deckboards also provides a weakened area at the point of countersinking, causing the deckboards to break at the weakened point.

Application Ser. No. 796,652 filed May 13, 1977 discloses pallets constructed from deckboards nailed to stringers which may be notched or unnotched and include a metal pin or a pin of another material having structural strength greater than that of wood between the end and notch of conventionally use stringers or at the ends of the stringer. The pin is completely embedded within the stringer. In fabrication of the improved pallet, the stringers are cut to proper length and, if a four-way pallet, notched as conventionally done. However, the stringers are then drilled in the vertical direction either completely through or substantially through and a pin inserted. The pins are embedded and positioned in the stringer so as not to interfere with the nailing of deckboards with automatic nailers or the like. The stringers with the pins inserted are then used in the fabrication of the pallet in a conventional manner as, for example, by feeding the stringers into automatic stringer feed boxes and applying the deckboards, top and bottom, with nail handguns or automatic nailers.

Copending application Ser. No. 796,652 filed May 13, 1977 now abandoned also discloses the use of a U-shaped rod running lengthwise of the stringer, extending over the notched portions of the stringer with the ends of the U extending vertically down into the stringer. The rod is fitted into a groove in the stringer so as not to interfere with deckboard placement.

As a still further embodiment, Ser. No. 796,652 filed May 13, 1977 discloses the use of U-shaped rods extending endwise from stringer to stringer of the pallet and extending vertically downward into the stringer. This embodiment provides improved structural strength to the pallets and, further, helps to hold the stringers of the pallet in squared relation, decreasing the stress on the deckboards.

The pallets made in accordance with the disclosure of Ser. No. 796,652 have greatly improved strength particularly at the ends of the pallet or stringer adjacent to the notch where notched pallets are most often damaged by being struck with the fork end of a forklift truck or the like. The structural strength of the pallets is fully equivalent or greater than the structural strength of pallets using deck bolts or rods. However, unlike with the use of bolts and rods, the pallets can be rapidly constructed using conventional automated equipment and can be repaired in a conventional manner since the pins, being fully enclosed within the stringer, for purposes of working the pallet are as if not there. Moreover, an advantage over the use of bolts is that there is no weakening of the deckboards through drilling and countersinking of boltheads, or the like. Of equal or greater importance, however, is that when a pin-reinforced stringer is struck by the tines of a forklift truck the pin, although not preventing the splitting of the stringer which is a virtual impossibility, arrests or stops the splitting or cleaving of the stringer end substantially at the pin. Although the stringer is cleaved and in part separated, the relative movement between the steel pin and the wooden stringer permits the forcing together of the separated stringer parts by pounding or the like and the pallet retained in normal service.

OBJECTS OF INVENTION AND GENERAL DESCRIPTION

It has now been found that U-shaped elements, in addition to contributing to the structural strength of the pallet as disclosed in Ser. No. 796,652, will function through a modification in the positioning of the U member in the pallet to help position and retain cargo on the pallet.

In accordance with a primary object of the present invention, therefore, pallets having deckboards nailed to vertical stringers and including reinforcing pins at strategic locations in the stringers of the pallets as disclosed in application Ser. No. 796,652 are modified to include U members on at least the two sides or the two ends of the pallet, the U members extending a sufficient distance above the top deckboards of the pallet to position and retain cargo thereon such as cases or cartons of beverages. The ends of the U member are disposed substantially completely through the vertical stringer so as to provide reinforcement and protection to the stringer ends and, if notched, adjacent to the notched ends and effectively serve as the reinforcing pin as disclosed in Ser. No. 796,652 and function in the same manner as such pins. As will be apparent, in addition to the reinforcement provided by the U members as presently disclosed, additional reinforcing pins strategically positioned within the pallets will provide additional reinforcement to the stringers. At times, however, sufficient reinforcement is obtainable with the U members extending into and substantially completely through the stringer, precluding a need for additional reinforcing pins.

In fabrication of the pallets, the stringers are cut to the proper length and, if a four-way pallet is desired, notched as conventionally done. However, the stringers are then drilled in the vertical direction substantially completely through at the ends thereof so as to receive the upward extending U member. By being substantially completely through the end of the stringer, reinforcement of the stringer and protection of the stringer at the critical position, i.e., the end of the stringer, is accomplished. In the event steel pins are to be utilized for reinforcement of the stringers at other strategic locations, the stringers are suitably drilled so that the pins can be inserted so as to be disposed completely within the stringers. Thereafter, the stringers with the pins inserted are then used in fabrication of the pallet in a conventional manner as, for example, by feeding the stringers into automatic stringer feeding boxes and applying the deckboards top and bottom with nail guns or automatic nailers. Thereafter, the U members which are to extend above the deckboards are properly inserted to provide the finished pallet. The U members will extend above the top deckboards a sufficient distance to position and retain cargo, which is normally from about two to ten inches and preferably from about four to eight inches.

DETAILED DESCRIPTION AND DRAWING

Figure 1:
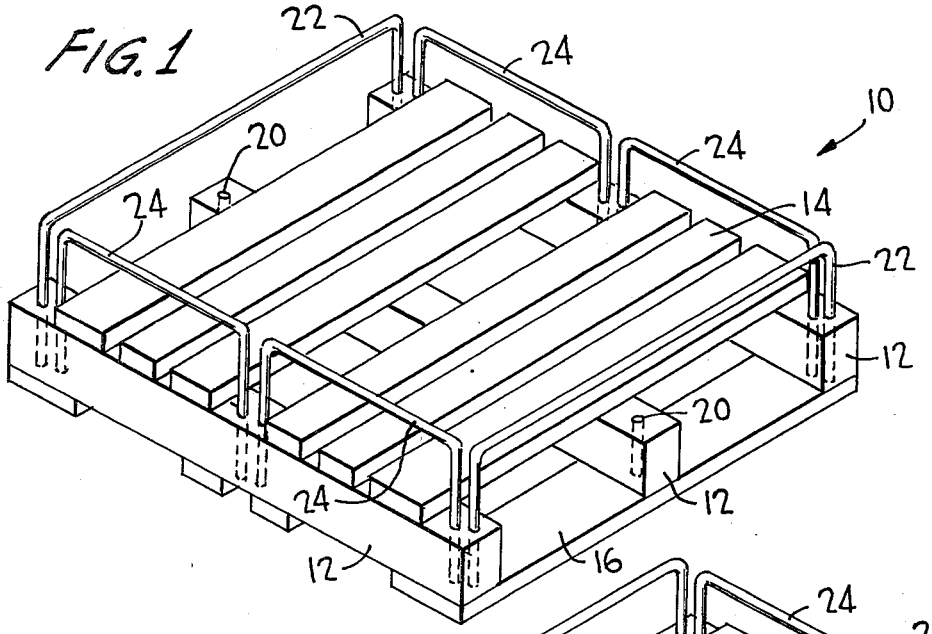
Figure 2:
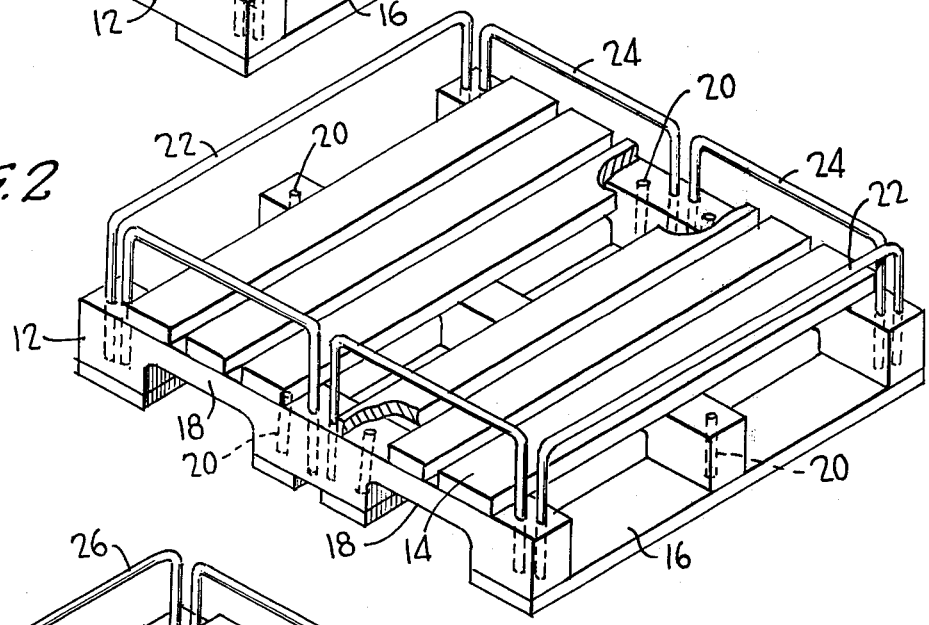
Figure 3:
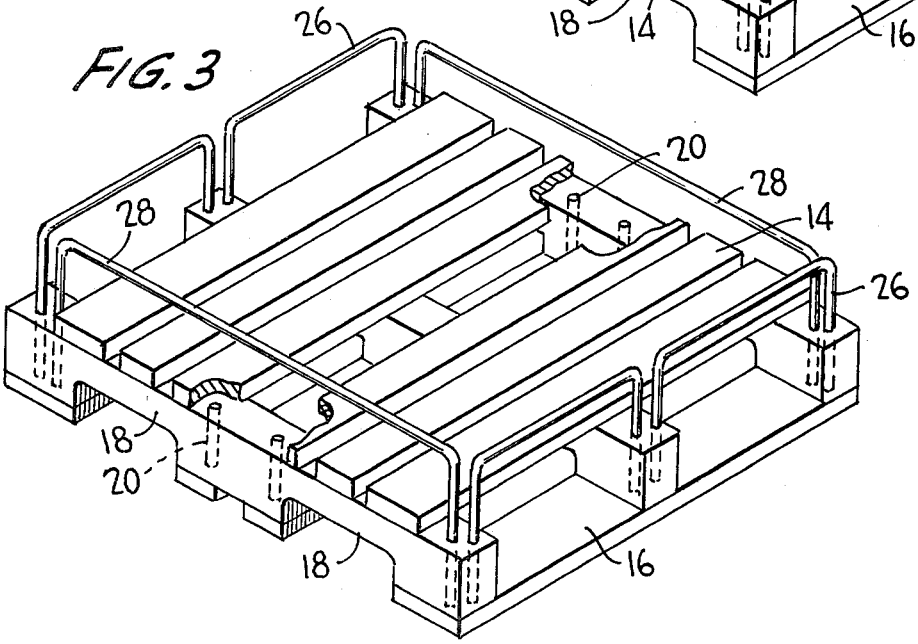

Having described the invention in general terms, specific embodiments will be described with reference to the drawing wherein FIG. 1 is an elevational view of a two-way pallet;

FIG. 2 is an elevational view of a four-way pallet, i.e., a pallet using notched stringers, partially cut away to illustrate the use of reinforcing metal pins; and FIG. 3 is an elevational view of another embodiment of a four-way pallet, partially cut away to illustrate the use of reinforcing metal pins.

Referring to the drawing wherein like elements are identified with like numerals, FIG. 1 illustrates the construction of a two-way pallet 10 wherein three unnotched wooden stringers 12 have top boards 14 and bottom boards 16 nailed thereto. The center stringer has a reinforcing pin 20 disposed completely within each end of the stringer to protect the stringer from damage when struck with the fork of a forklift truck. Additionally, a U member 22 extends across from the two side stringers at each end of the pallet. The U member is constructed so that the ends thereof extend substantially through the stringer as shown in broken lines. The central part of the U member extends above the deckboard to position and retain cargo on the pallet. Additionally, as shown in FIG. 1, two U members 24 are positioned on each side of the pallet so that the entire side of the pallet is enclosed with the U member with the ends of the U member again extending substantially completely through the stringer to provide additional reinforcement at the ends of the stringers and again are constructed and arranged to extend above the top deckboard so as to further help position and retain cargo on the pallet.

FIGS. 2 and 3 illustrate four-way pallets made in accordance with the present invention. In the four-way pallet stringers 12 have notches 18 cut therein which permit entrance of the forks of a forklift truck from the sides of the pallet as well as from the ends. As seen from FIGS. 2 and 3, reinforcing pins 20 are strategically positioned adjacent to each end of each notch on the stringer so as to provide reinforcement of the stringer at the point where the fork of a forklift truck is most likely to strike and damage the stringer. Additionally, as will be apparent, in FIG. 2 the pallet utilizes U members as shown in FIG. 1 and as described with reference to FIG. 1.

The pallet of FIG. 3 is modified to the extent that a single U member 28 extends the full length of each side of the pallet. Additionally, two short U members 26 are used at each end of the pallet. As will be apparent, various other modifications can be made in accordance with the present invention including using a plurality of short U members at both the sides and ends of the pallets. Moreover, U members can be strategically located in the pallets as shown in the aforesaid Ser. No. 796,652. Additionally, the use of a greater number or a lesser number of pins strategically positioned in the pallet as shown in the aforesaid Ser. No. 796,652 can be used in conjunction with the herein described cargo positioning and retaining U members. The choice of construction within the scope of the teaching herein and in conjunction with the teaching of Ser. No. 796,652 will depend upon the end use of the pallet.

The pins which are used in the embodiment of FIGS. 1–3 preferably are metal pins inserted in the stringer at the time of notching and drilling. These reinforcing pins can have a rough surface including grooves or the like to provide a snug fit thereby precluding the falling out of the pins prior to the placement of deckboards over the pin in pallet fabrication. However, the pins whether separately formed or as the ends of a U member must have a surface sufficiently smooth to permit relative movement between split stringer parts and the pin U member ends so as to permit repeated repair of a stringer by the forcing together of cleaved stringer parts around the pin or U member end without destruction of the stringer. Moreover, the pin during fabrication of the total pallet must be interlocked within the stringer either as a result of a snug or interference fit provided by a roughened or grooved pin surface or by forcing a smooth surfaced pin into a smaller diameter hole, or as a result of the positioning of the deckboards to prevent the pin from being displaced when the stringer is split.

Accordingly, whether the pin is completely enclosed or substantially completely enclosed within the stringer, or is the end of a U member which extends through or substantially through the stringer, it must have a diameter sufficient to arrest the cleavage of the stringer when the stringer is struck by the tine of a forklift truck, and have a surface which will permit relative movement between the split stringer parts so as to allow repeated repair of a stringer by the forcing together of cleaved stringer parts around the pin. It has been found that pins having a diameter of three-eighths of an inch are adequate to reinforce a stringer which is about one and one-half to two inches in width. In the event the width of the stringers increase, the diameter of the pin may also be desirably increased. Preferably, the pin will extend substantially all the way through the vertical length of the stringer. However, the pin can be somewhat shorter than the stringer with reinforcement being provided. The U members employed are preferably made from a metal rod having a diameter of three-eighths of an inch. However, the diameter, as with the pins, can be varied depending on the size of the stringers and the end use of the pallet.

Although various embodiments have been discussed and shown, it will be apparent to one skilled in the art that additional modifications can be made with respect to the number and positioning of the pins and U-shaped members. The preferred embodiments shown herein are not to be construed as a limitation of the invention.

It is claimed:

1. A pallet having two ends and two sides for material transport to be handled with a forklift truck comprising a plurality of longitudinally extending solid wooden stringers, transverse top deckboards fixedly secured to said longitudinally extending stringers and at least two U members positioned opposite of each other, the ends of said U members fitted into drilled holes in said stringers and extending vertically into and substantially completely through said stringers in at least a semi-permanent fit, and said U member being constructed and arranged with said stringers and deckboards to extend a distance above said top deckboard sufficient to position and retain cargo on said pallet without passing through said deckboards, the ends of said U members fitted into said drilled holes in said stringers being of a diameter sufficient to arrest cleavage of said stringer when said stringer is struck by the tine of a forklift truck, and said ends having a surface sufficiently smooth to enable relative movement between split stringer parts and said U member ends subsequent to any such cleavage so as to permit repeated repair of a stringer by the forcing together of cleaved stringer parts around said U member ends.

2. The pallet of claim 1 wherein said U members are positioned at each of said ends.

3. The pallet of claim 1 wherein said U members are positioned at each of said sides.

4. The pallet of claim 1 wherein said U members are positioned at each of said ends and at each of said sides of said pallet.

5. The pallet of claim 1 wherein at least the outermost stringers of said plurality of stringers has a drilled hole at each end and an additional reinforcing pin in each said drilled hole enclosed and interlocked within said stringer, said pin being of a diameter sufficient to arrest cleavage of said stringer when said stringer is struck by the tine of a forklift truck, and said pin having a surface sufficiently smooth to enable relative movement between split stringer parts and said pin subsequent to any such cleavage so as to permit repeated repair of a stringer by the forcing together of cleaved stringer parts around said pin.

6. The pallet of claim 5 wherein the stringers are notched so as to permit entrance of the fork of a forklift truck at the sides of said pallet and wherein at least the outermost stringers of said plurality of stringers has a drilled hole at each end and adjacent said notch and a reinforcing pin in each said drilled hole enclosed and interlocked within said stringer, said pin being of a diameter sufficient to arrest cleavage of said stringer when said stringer is struck by the tine of a forklift truck, and said pin having a surface sufficiently smooth to enable relative movement between split stringer parts and said pin subsequent to any such cleavage so as to permit repeated repair of a stringer by the forcing together of cleaved stringer parts around said pin.

* * * * *